United States Patent [19]

Anderson

[11] Patent Number: 4,773,297

[45] Date of Patent: Sep. 27, 1988

[54] PAGE TURNING DEVICE

[76] Inventor: Wendell Anderson, 2459 Franciscan Dr., Apt. A-23, Clearwater, Fla. 33575

[21] Appl. No.: 37,461

[22] Filed: Apr. 13, 1987

[51] Int. Cl.[4] ..... G10G 7/00

[52] U.S. Cl. ..... 84/521; 40/531

[58] Field of Search ..... 84/486, 521; 40/531, 40/533

[56] References Cited

U.S. PATENT DOCUMENTS

| | | | |
|---|---|---|---|
| 921,496 | 5/1909 | Young | 84/521 |
| 1,531,921 | 3/1925 | Gibbs | 84/521 |
| 4,072,080 | 2/1978 | Conlin | 84/486 |

*Primary Examiner*—L. T. Hix
*Assistant Examiner*—Brian W. Brown
*Attorney, Agent, or Firm*—Stanley M. Miller

[57] ABSTRACT

A page turning device. Ferrous flat plate members are detachably secured to the pages to be turned of a book. A magnet member is carried by an elongate arm member that is pivotally mounted to swing in a plane. In a first embodiment, a spring member under load urges the arm member to swing in its plane to an equilibrium position, carrying a magnetically-engaged flat plate member and hence a page member with it. A stop member maintains the arm member in its nonequilibrium position until the musician desires the page to turn; a latch member is activated to transiently displace the stop member from its stopping engagement with the arm member. The musician thereafter returns the arm member to its first position. In a second embodiment, a motor causes the arm member to swing in its plane, carrying one page with it each time it travels from its first to its second position. The motor includes a limit switch that is operative to return the arm member to its plate and hence page-engaging position after each page turning motion has been accomplished. In either embodiment, a peg member carried by the arm member may be employed to turn a single page in the absence of any magnetic engagement between the magnet and the ferrous plate members.

14 Claims, 3 Drawing Sheets

PAGE TURNING DEVICE

BACKGROUND OF THE INVENTION

1. Field of the Invention

This invention relates, generally, to devices designed to turn the pages of a book one page at a time. More particularly, it relates to a device intended for use as a sheet music page turning device, and still more specifically it relates to a device that in some embodiments uses magnetism, biasing means, and a unique magnet-disengaging means to turn pages while in another embodiment it eschews the use of magnetism.

2. Description of the Prior Art

Musicians of course read music from books commonly known as sheet music books. In the course of playing a tune, whether for personal pleasure, practice, recording, or before a live audience, it often becomes necessary for the musician to turn the pages of the sheet music at a time when it is not convenient to do so.

Some musicians solve this problem by asking another musician or at least someone who can read music to sit by the music stand and to turn the pages as required. This is obviously a waste of human resources.

There have been some attempts to invent page turning devices, but as of the date of this disclosure, no page turning device known to the present inventor or his agents has ever met with any significant measure of success in the marketplace.

A typical patent of the prior art is U.S. Pat. No. 4,072,080 to D. Conlin, awarded in 1978. The Conlin device includes a base which supports a vertical shaft upon which a plurality of page holding elements are rotatably mounted in an annular guide member. A number of sleeves are mounted rotatably on the vertical shaft and are operatively connected to the page holder elements. A retaining pin prevents advance of the page holder elements along the guide member. A foot controller, or alternatively an electric motor is operatively connected to the retaining pin to permit manual or automatic release to thereby enable the page holder elements to advance and the pages to turn.

The Conlin device thus achieves its objective, but it is clear that the art of page turning devices has not yet reached its full development.

SUMMARY OF THE INVENTION

The inventive structure fills the longstanding but heretofore unfulfilled need for a page turning device that is economical to manufacture, easy to use, and reliable.

The novel structure includes a stand means that is used in lieu of conventional stands for holding sheet music; the novel stand means is easily connectable to a conventional stand means, however.

A book of sheet music is placed on the novel stand means in a conventional manner; the stand means includes clip means, for example, that slideably and releasably engage the cover of the book of sheet music to hold the book open on the stand. A vertically adjustable shelf member positioned substantially in a horizontal plane cooperates with a frame member positioned in a substantially vertical plane to hold the music in the same manner as conventional stand means lacking page turning attachments.

In some embodiments of the invention, the pages of the sheet music to be turned are fitted with detachable steel plate members or plate members formed of any other suitable ferrous material; preferably, the metallic plate members are simply clipped on by any suitable means to each page to be turned, at the lower right hand corner thereof.

An elongate arm member having a magnet member fixedly secured to its distal free end is pivotally secured at a pivot point adjacent the shelf member which pivot point is offset from the center of said shelf member.

The arm is first swung against a bias means into a nonequilibrium position until its magnet member overlies and magnetically engages the flat plate member clipped to the first page to be turned; a stop means maintains the arm member in this loaded, nonequilibrium condition until a pivotally mounted latch means is pivoted slightly by the musician. The activation of the latch means displaces the stop member and releases the tension of the arm so that it swings back to its equilibrium position, carrying the plate member and hence a page with it.

Due to the offset or eccentric mounting of the arm member with respect to the shelf member and hence with respect to the book of sheet music, when the arm swings to its equilibrium position under the influence of its biasing means, the page-mounted plate member and the arm magnet slidingly disengage from one another.

Accordingly, at any convenient pause in the music after the page has been turned, the musician need only swing the arm back to its nonequilibrium condition so that the next page's plate member can be magnetically engaged by the arm member magnet. The arm will be held in place by the stop means until the musician again activates the latch means when it is desired to turn another page.

Some short pieces may be printed entirely in three or four pages so that only one turning operation is needed; for such short pieces, the inventive device provides an upstanding peg member which is carried by the arm member and which is positioned behind the page to be turned so that when the latch means is activated, the swinging of the arm member to its equilibrium position turns the page in the absence of any magnetic engagement between the arm and the page. The peg means is slideably mounted with respect to the arm member so that it can be retracted into its stored position when multiple pages are to be turned sequentially.

Another embodiment employs a reversible motor means to turn the pages.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
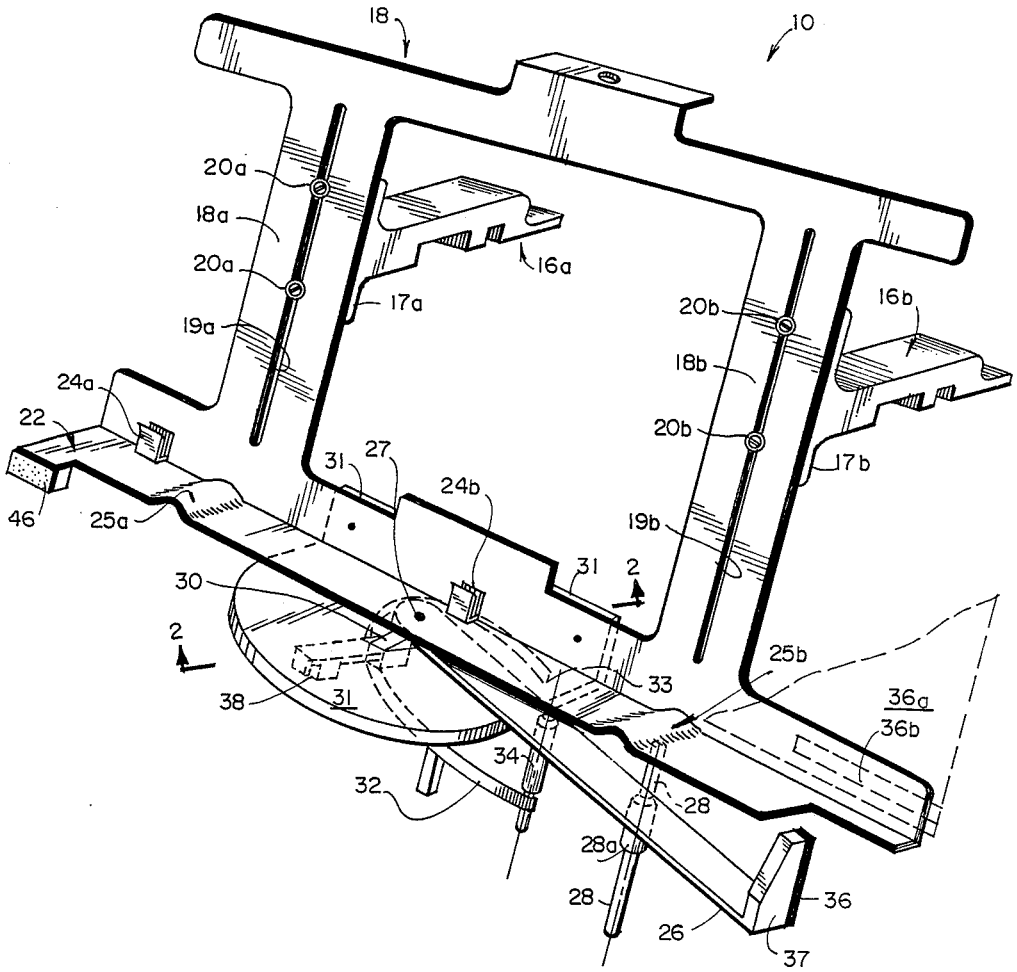
FIG. 1 is a perspective view of the novel apparatus.

Referring now to FIG. 1, it will there be seen that an illustrative embodiment of the invention is denoted by the reference numeral 10 as a whole.

Figure 3:
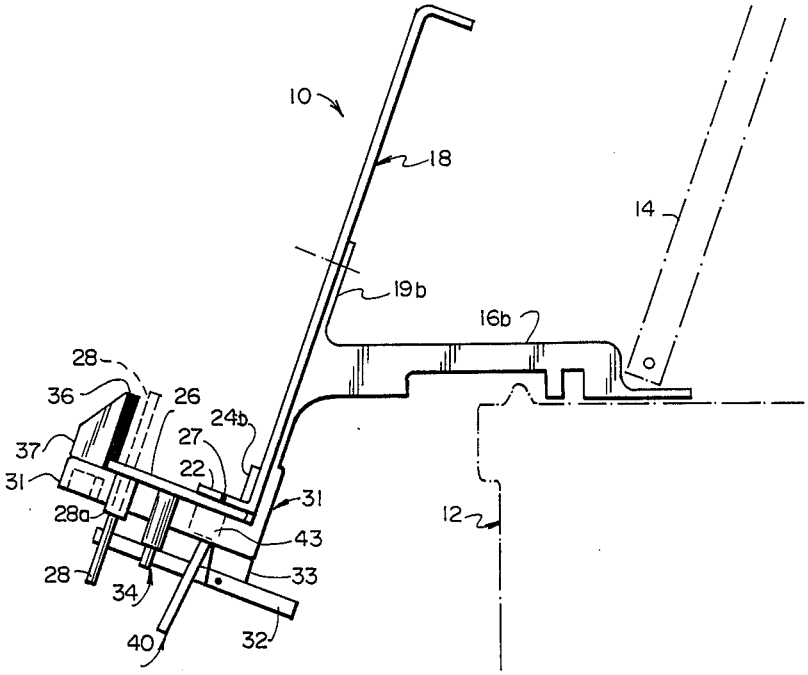
FIG. 3 is a side elevational view of the novel device positioned in its intended environment.

The structure of the device 10 is perhaps best understood by making reference to both FIGS. 1 and 3. As depicted in FIG. 3, an organ or piano 12 has a conventional music-holding rack means denoted 14; the present invention is employed in conjunction with said rack means 14 as is clear from an inspection of FIG. 3.

One advantage of the invention is that it allows the music to be held closer to the musician and closer to the keyboard as is clear from FIG. 3; moreover, as will be hereinafter set forth, the height at which the music may be held is adjustable when the novel device is employed.

Musicians will recognize that the relative positioning of the novel device as depicted in FIG. 3 with respect to the keyboard of the piano or organ is highly advantageous, especially for musicians who require glasses of any kind. Moreover, the proximity of the music to the keyboard enables the musician to see the keyboard and the music substantially simultaneously, a feat not possible when the music is placed on conventional rack means 14.

The base member of the novel device includes two separate but like elements which are denoted by the reference numerals 16*a*, 16*b* in the drawings; elements 16*a*, 16*b* interconnect with a piano or organ in the manner shown in FIG. 3.

Each base element 16*a*, 16*b* terminates in a canted frame support means 17*a*, 17*b*.

A frame member 18 is adjustably supported by said frame support means 17*a*, 17*b*, as best shown in FIG. 1; frame member 18 has laterally spaced frame elements 18*a*, 18*b* which are slotted as at 19*a*, 19*b* to receive screw members 20*a*, 20*b* which screw threadedly engage said frame support means 17*a*, 17*b*, respectively, and which, when tightened, retain elements 18*a*, 18*b* in tight sandwiched relation between the head portions of said screw members 20*a*, 20*b* and said frame support means 17*a*, 17*b*. Hence, loosening of said screw members enables frame member 18 to be vertically adjusted with respect to a keyboard.

An elongate shelf member 22 is integral with frame member 18 and is positioned normal thereto as shown so that a book of sheet music may be positioned thereatop and supported thereby. Just as conventional rack 14 is slightly tilted from the vertical, frame member 18 is also so tilted to ensure that the book will not easily fall off the shelf member 22.

A pair of clip members 24*a*, 24*b* are provided, however, to further retain the music in place; as is well known, the cover of a music book is slipped into each clip member to maintain the covers of the book in their open configuration.

A pair of spaced bulges or other suitable projections 25*a*, 25*b* are formed in shelf member 22 as shown in FIG. 1 to lift the book slightly above the plane of shelf member 22 to thereby bring the bottom edge of the book, not shown, into alignment with the bottom of the clip means 24*a*, 24*b*.

Device 10 may be employed even if a short piece of music requires but a single page turning; accordingly, the single page turning embodiment of the invention will be first described.

An elongate arm member 26 is pivotally mounted at pivot point 27 to the underside of shelf member 22 and is thus movable in a plane between the position shown in solid lines in FIG. 1 to a position nearly one hundred eighty degrees rotated therefrom.

The position of arm member 26 which is depicted in solid lines in FIG. 1 is its first, loaded, or nonequilibrium position; the position of arm member 26 after it has fully rotated about pivot point 27 is its second or equilibrium position.

An aperture means is formed in arm member 26 near its distal free end and an upstanding peg member 28 is slideably received within said aperture means; a boss member 28*a*, fixedly secured to the underside of arm member 26 in registration with said aperture means, also slideably receives and guides said peg member 28.

Accordingly, peg member 28 may assume both an "up" and a "down" position; the former position is its operative position and the latter position is its stored or inoperative position although the peg member may be used even when in its stored position in the manner set forth hereinafter.

FIG. 1 shows the "up" position of peg member 28 in phantom lines and the stored or "down" position thereof is depicted in solid lines; the same is true of FIG. 3.

A stop member 30 abuttingly engages arm member 26 near pivot point 27 as is clearly shown in FIG. 1 and said stop member 30 maintains said arm member 26 in its nonequilibrium or first position.

Arm 26 requires stop member 30 to maintain its first position because an elongate leaf spring member 32 urges said arm member 26 to swing about pivot point 27 to its second, equilibrium position.

A semicircular in configuration guide plate member 31 underlies arm member 26 and guides said arm member as it swings from its first position to its second; as is perhaps best depicted in FIG. 3, guide plate member 31 is fixedly secured to frame member 18 and has a planar major portion that is spaced downwardly of shelf member 22. The proximal end of arm member 26 is thus disposed in sandwiched relation between the underside of the shelf member 22 and the top side of guide member 31; sufficient clearance is provided to allow the pivoting of the arm member 26 about pivot point 27, of course.

Spring member 32 has its proximal end fixedly secured to a suitable mounting block means 33 that is fixedly secured to the underside of guide plate member 31, as best shown in FIG. 3.

The distal end of spring member 32 is fixedly secured to a post member 34 that depends to arm member 26 as shown. A return or other sufficient bend is formed in spring member 32 at the time of device assembly so that when spring member 32 is bent or distorted as shown in phantom lines in FIG. 1, a tension is applied to arm member 26 which urges it to assume its equilibrium or second position.

Stop member 30, as above suggested, prevents pivoting of arm member 26 about pivot point 27 under the influence of spring member 32 until said stop member is released by the musician at the time a page turning is desired.

To turn a single page, the musician places peg member 28 in its "up" position and further places said peg member 28 behind the page to be turned; this of course involves placing arm member 26 in its first position. Stop member 30 is biased into its arm-locking position so the musician needs only to place the peg member 28 and arm member 26 into their respective positions as just described without setting or otherwise manipulating stop member 30.

When the time for turning the page arrives, the musician releases the stop member 30 in the manner hereinafter described and the bias supplied by spring member 32 causes said arm member 26 to swing about pivot point 27 to its second position; this same path of travel is therefor followed by peg member 28 and the page member overlying it and thus the desired page turning is accomplished.

Where multiple pages are to be turned in sequence, peg member 28 is placed into its "down" or stored positioned.

Instead, a flat metallic plate member is detachably secured to each of the page members that will need to be turned in the course of the playing of the score; for reasons that will be made clear, the plate members are secured to the lower right hand corner of each of the page members to be turned.

In FIG. 1, a fragmentary page member **36*a* having a plate member 36*b*** clipped thereto is depicted in phantom lines.

A magnet member 36 is carried by arm member 26 at its distal end; specifically, an enlarged magnet support member 37 is provided at the distal end of arm member 26 to provide a support surface upon which magnet member 36 is permanently mounted.

The musician magnetically interconnects the page member plate means **36*b* and the magnet member 36 when arm member 26 is placed into its "ready" or first position; more specifically, magnet member 36 is brought into overlying registration with the page member plate 36*b* and the ferrous or ferric composition of said plate member results in a magnetic coupling of the magnet member 36 and plate member 36*b***.

Thus, when stop means 30 is released by the musician, arm member 26 rotates under the influence of spring member 32 to its second position and the magnetic engagement of magnet member 36 and the plate member **36*b* carries a page member 36*a*** toward said second position.

As aforesaid, pivot point 27 of arm member 26 is offset with respect to the center of shelf member 22; accordingly, when the arm member swings in its plane to its second position, the arm member magnet 36 and the plate member **36*b* will slide with respect to one another and ultimately disengage as the second position of arm member 26** is achieved.

After a page **36*a* has been turned in said manner, the musician may return the arm member 26 to its first position at any convenient time. Arm member 26 may be grasped directly and rotated about its pivot point 27, or the "down" peg member 28 may be grasped instead and used as a handle means for returning said arm member 26 to its first position. Time is not of the essence on this return stroke of the arm member 26**.

Figure 2:
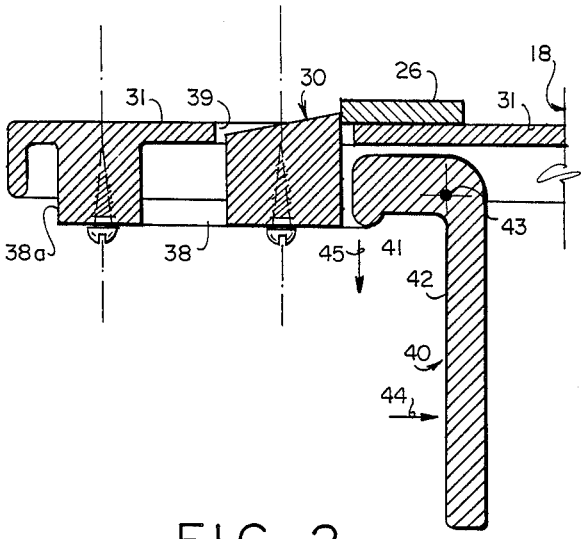
FIG. 2 is a sectional view taken along line 2—2 of FIG. 1.

The mechanism that releases stop member 30 in both the single page and multiple page embodiments of the invention is best shown in FIG. 2; there it will be seen that stop member 30 is fixedly secured to a resilient leaf spring member 38 which member 38 is fixedly secured by suitable means to a suitable mounting block member **38*a* that depends to or is integral with the underside of guide plate member 31** as shown.

An aperture means 39 is formed in guide plate member 31; stop member 30 extends upwardly through said aperture means 39 and the uppermost part of stop member 30 abuts arm member 26 to maintain said arm member 26 in its first position.

A latch member 40 has a truncate portion 41 and an integral elongate portion 42; it is pivotally mounted as at 43 intermediate a pair of laterally spaced ear members secured to the underside of guide plate member 31.

Displacement of elongate portion 42 of latch member 40 in the direction indicated by single-headed directional arrow 44 causes truncate portion 41 to displace resilient leaf spring member 38 downwardly; stop member 30 is thereby carried out of its abutting engagement with arm member 26 and said arm member returns to its second position under the influence of spring member 32 as aforesaid, carrying a page **36*a*** with it.

Leaf spring member 38 is resilient as aforesaid and as suggested by the double-headed directional arrow 45 in FIG. 2; accordingly, release of latch member 40 causes said latch member to return to its equilibrium state, i.e., to the state where leaf spring member 38 assumes its planar, undistorted or equilibrium position, which position is depicted in FIG. 2.

Thus, release of latch member 40 returns the stop member 30 to its operative position, i.e., to the position where its uppermost portion extends through aperture means 39 formed in guide plate member 31. Hence, the musician simply returns arm member 26 to its first position and the stop member 30, having a canted top surface as shown in FIG. 2, will momentarily be driven into its aperture means 39 as the arm member 26 sweeps over it, but leaf spring member 28 will restore said stop member to its operative position immediately after the arm member 26 has returned to its first position.

There are numerous means whereby the operator-musician can effect pivoting of latch member 40 about pivot point 43. The most expedient means is to simply depress the latch member 42 with a finger. However, a cable and pulley mechanism, not shown, or other suitable mechanical means, coupled with a foot pedal, for example, could be employed to accomplish the desired pivoting of latch member 40 about its pivot point 43.

The activation of latch member 40 causes arm member 26 to assume its second, equilibrium position rather abruptly; accordingly, a pad member, denoted 46 (FIG. 1), is secured to the leading edge of shelf member 22 as shown to cushion the impact of arm member 26 thereagainst.

Those skilled in the art of machine design will appreciate that the mechanism just described can be modified in many ways and still be within the spirit of this invention; as one obvious example of how the mechanism could be changed, the elongate leaf spring member 32 could be replaced by a coiled torque spring member of cylindrical configuration that would have its axis of symmetry positioned coincident with pivot point 27; placing arm member 26 in its first position would load said torque spring member and activation of the latch member 40 would allow said torque spring member to unload and thus swing arm member 26 to its second position. More particularly, the uppermost end of the coiled torque spring member would be secured to arm member 26 when said arm member is in its second position and the lowermost end of said torque spring member would be fixedly secured to any suitable fixed position mounting means so that rotation of arm member 26 into its first position would serve to bring said torque spring member into its loaded, nonequilibrium condition.

Figure 4:
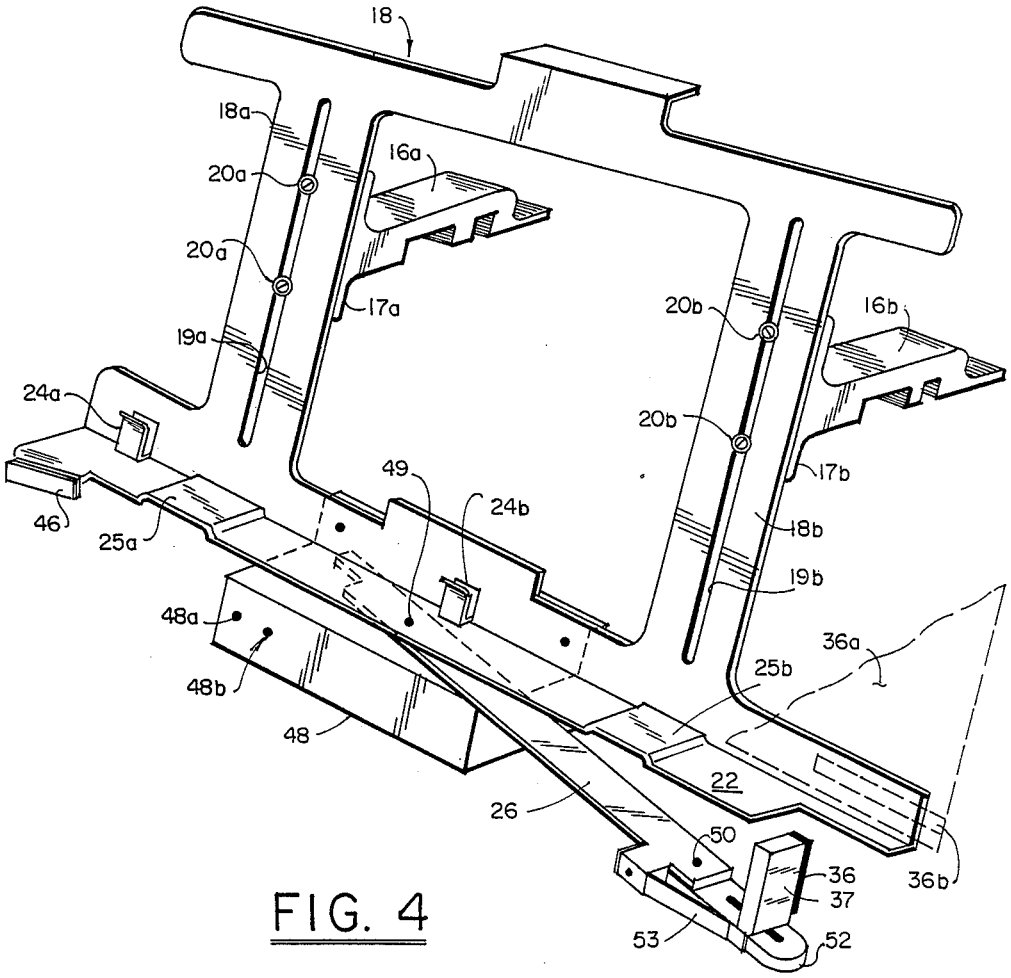
FIG. 4 is a perspective view of an alternative, motorized embodiment of the invention.

FIG. 4 shows an embodiment of the invention that eliminates both elongate leaf spring member 32 and the above-mentioned torque spring member.

In this embodiment, a motor means 48, having a power jack 48*a* and a push button on-off switch 48*b*, causes the rotation of an output shaft means 49 which shaft means 49 is positioned at the same position as pivot point 27 in the non-motorized embodiments of this invention.

Arm member 26 is fixedly secured to shaft means 49 and thus is carried thereby. When the musician wants a page 36*a* to be turned by the device, he or she pushes button member 48*b;* motor 48 activates and shaft 49 carries arm member 26 to its second position, thereby turning a page. A limit switch, not shown, is provided so that when said arm member 26 achieves its second position, it activates the limit switch which in turn reverses the direction of shaft 49 rotation, thereby returning arm member 26 to its first position so that the next page member plate member 36*b* is magnetically engaged.

The swings of the arm member 26 may occur abruptly, and for this reason the distal end of the arm member 26 is articulated as shown in FIG. 4 and other means are provided to attenuate the shock of impact when a stroke is being completed.

Specifically, a pivot point 50 is provided for pivotal mounting of an arm member extension 52 which carries magnet means 36. A leaf spring member 53 provides a forward bias to urge extension member 52 into the position depicted in FIG. 4; thus, when magnet member 36 strikes a page member plate means 36*b* upon completion of a return stroke, for example, extension member 52 will momentarily recoil from the impact as permitted by its pivotal connection with arm member 26, and will thereafter be returned to its equilibrium state under the influence of spring member 53.

Motor means 48 and its limit switch means are preferably of the double pole, double throw type.

In all other respects, the embodiment of FIG. 4 operates in the same manner as the first-described embodiments. As in the other embodiments, a foot pedal or other suitable means could be employed to obviate the need for the pushing of button 48*b* when a page turning operation is desired.

Clearly, the present invention is a well thought out and highly developed page turning device. It can turn the pages of any book, of course, not just books of sheet music. Moreover, it can be used by orchestra conductors, reed, brass and other wind instrument players, string instrument players and the like, not just organists and pianists. It pioneers the art of page turning devices by providing a significant number of breakthroughs and by bringing to the art a level of sophistication heretofore to it unknown.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A device for turning the pages of a book of sheet music comprising:

a stand means for supporting a book of sheet music;

said stand means including a frame member having a generally vertical disposition;

said stand means further including a shelf member positioned contiguous to a bottom portion of said frame member to support a book of sheet music having a plurality of page members, a rear portion of said book being abuttingly supported by said frame member;

a flat page member plate means of ferrous composition detachably secured to each of said page members, at a lower right hand corner thereof;

an elongate arm member pivotally mounted to said stand means, in eccentric relation to said book of sheet music, said arm member being movable in a generally horizontal plane;

an arm member magnet means fixedly secured to a distal free end of said arm member;

a bias means that biases said arm member into a first, nonequilibrium position where said arm member magnet means overlies and magnetically engages a page member plate means when said book of sheet music is in an open configuration;

a bias release means that allows said elongate arm member to pivotally swing to a second, equilibrium position;

said bias release means including a movably mounted stop member that abuttingly engages said arm member when said bias means is loaded, said stop member thereby preventing said arm member from swinging to its equilibrium position under the influence of said bias means;

said arm member magnet means and said page member plate means slideably disengaging from one another attendant the movement of said arm member to its equilibrium position due to the eccentric mounting of said arm member with respect to said book of sheet music;

said movement of said arm member operative to turn a page member of said book of sheet music;

said arm member being returnable to its nonequilibrium, next page member means-engaging position by an operator of said device;

wherein said stop member is mounted on a resilient base member so that when said stop member is displaced to thereby allow release of tension on said arm member, said displacement of said stop member transiently deforms said base member, said base member thereafter returning to its equilibrium state due to its resiliency.

2. The device of claim 1, further comprising an arm member guide means that guides said arm member to its equilibrium position when said arm member bias means is released.

3. The device of claim 2, wherein said guide means is a substantially horizontally disposed plate member that is positioned downwardly of said shelf member, in slightly spaced relation thereto.

4. The device of claim 3, wherein said arm member is positioned downwardly of said shelf member and upwardly of said guide member, in sandwiched but sliding relation therebetween.

5. The device of claim 4, wherein an aperture means is formed in said guide member, and wherein said stop member has a major, lower portion positioned below the plane of said guide member and a minor, upper portion that extends through said aperture means and abuttingly engages said arm member to maintain said arm member in its loaded or nonequilibrium state.

6. The device of claim 5, wherein said bias release means further comprises a pivotally mounted latch means operative to move said stop member out of its abutting engagement with said arm member by causing said stop member to recede into said aperture means.

7. The device of claim 6, wherein said latch means includes a generally horizontally disposed minor portion that overlies and abuttingly engages said resilient base member when said latch means is in an equilibrium state, wherein said latch means further includes a generally vertically disposed major portion integral to said minor portion, and wherein pivoting of said latch means by an operator of said device causes said minor portion of said latch means to transiently displace said resilient base member to thereby release said bias means so that said arm member may swing to its equilibrium position, thereby turning a page member of said book.

8. The device of claim 7, further comprising a cushion member fixedly secured to said stand means adjacent said shelf member, said cushion member positioned so that when said arm member swings to its equilibrium state under the influence of said bias means, said arm member hits said cushion member to the end that the kinetic energy of said arm member is converted to heat energy at a relatively slow rate to thereby prolong the structural integrity of the stand means.

9. The device of claim 8, further comprising clip means for clipping outside cover members of said book to the frame member of said stand means.

10. The device of claim 9, wherein said frame member further comprises a frame member base means, and wherein said frame member is movably mounted with respect to said frame member base means and has a plurality of positions of vertical adjustment with respect to said frame member base means so that an operator may preselect the desired height of said frame member relative to said frame member base means.

11. A device for turning the pages of a book of sheet music comprising:

a stand means for supporting a book of sheet music;

said stand means including a frame member having a generally vertical disposition;

said stand means further including a shelf member positioned contiguous to a bottom portion of said frame member to support a book of sheet music having a plurality of page members, a rear portion of said book being abuttingly supported by said frame member;

a flat page member plate means of ferrous composition detachably secured to each of said page members, at a lower right hand corner thereof;

an elongate arm member pivotally mounted to said stand means, in eccentric relation to said book of sheet music, said arm member being movable in a generally horizontal plane;

an arm member magnet means fixedly secured to a distal free end of said arm member;

a bias means that biases said arm member into a first, nonequilibrium position where said arm member magnet means overlies and magnetically engages a page member plate means when said book of sheet musich is in an open configuration;

a bias release means that allows said elongate arm member to pivotally swing to a second, equilibrium position;

said arm member magnet means and said page member plate means slideably disengaging from one another attendant the movement of said arm member to its equilibrium position due to the eccentric mounting of said arm member with respect to said book of sheet music;

said movement of said arm member operative to turn a page member of said book of sheet music;

said arm member being returnable to its nonequilibrium, next page member means-engaging position by an operator of said device;

and an upstanding peg member carried by said arm member which peg member is positioned in underlying relation to a page member when said arm member is in its first position so that said page member is turned independent of any magnet means when said arm member swings from its first to its second position.

12. The device of claim 11, wherein said peg member is slideably mounted with respect to said arm member so that said peg member may be retracted below the plane of said arm member when not in use.

13. A sheet music page turning device, comprising:

a stand means for supporting a book of sheet music in an open configuration;

a page member means of flat configuration and of ferrous composition detachably secured to each sheet of music in said book at a lower right hand corner thereof;

a pivotally mounted elongate arm member having an arm member magnet means fixedly secured to its distal free end;

said pivotally mounted arm member having a first, loaded nonequilibrium position where said arm member magnet means overlies and magnetically engages a page member plate means;

said arm member magnet means and said page member plate means being disposed in non-abutting and magnetically disconnected relation to one another when said arm member is in its second position;

and an upstanding peg member carried by said arm member which peg member is positioned in underlying relation to a page member when said arm member is in its first position so that said page member is turned independent of any magnet means when said arm member swings from its first position to its second position.

14. The device of claim 13, wherein said peg member is slideably mounted with respect to said arm member so that said peg member may be retracted below the plane of said arm member when not in use.

* * * * *